US008714711B2

(12) United States Patent
Otaka et al.

(10) Patent No.: US 8,714,711 B2
(45) Date of Patent: May 6, 2014

(54) LIQUID RECORDING HEAD AND METHOD OF MANUFACTURING THE SAME

(75) Inventors: Shimpei Otaka, Kawasaki (JP); Takayuki Ono, Kawasaki (JP); Masao Furukawa, Yokohama (JP); Jun Hinami, Kawasaki (JP); Takeshi Shibata, Yokohama (JP); Ryo Shimamura, Yokohama (JP); Takanori Enomoto, Tokyo (JP); Tomohiro Takahashi, Yokohama (JP); Masashi Ishikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/596,634

(22) Filed: Aug. 28, 2012

(65) Prior Publication Data

US 2013/0063523 A1 Mar. 14, 2013

(30) Foreign Application Priority Data

Sep. 13, 2011 (JP) ..... 2011-199499

(51) Int. Cl.
*B41J 2/05* (2006.01)
*B41J 2/14* (2006.01)
*B41J 2/16* (2006.01)

(52) U.S. Cl.
CPC ..... *B41J 2/14024* (2013.01); *B41J 2/1623* (2013.01)
USPC ..... 347/64

(58) Field of Classification Search
CPC ..... B41J 2/14024; B41J 2/1621
See application file for complete search history.

(56) References Cited

U.S. PATENT DOCUMENTS

| | | | | |
|---|---|---|---|---|
| 7,300,596 | B2 | 11/2007 | Murayama et al. | |
| 8,114,305 | B2 | 2/2012 | Komiyama et al. | |
| 8,177,988 | B2 | 5/2012 | Komiyama et al. | |
| 8,210,647 | B2 | 7/2012 | Shimazu et al. | |
| 2002/0015073 | A1 * | 2/2002 | Beerling et al. | 347/42 |
| 2004/0238485 | A1 * | 12/2004 | Hayakawa et al. | 216/27 |
| 2006/0256162 | A1 * | 11/2006 | Hayakawa | 347/65 |
| 2008/0173616 | A1 * | 7/2008 | Sakurai | 216/27 |
| 2009/0065472 | A1 | 3/2009 | Asai et al. | |
| 2010/0302312 | A1 * | 12/2010 | Yamamoto et al. | 347/45 |
| 2011/0018930 | A1 * | 1/2011 | Bhwomik et al. | 347/22 |
| 2012/0013682 | A1 * | 1/2012 | Chida et al. | 347/47 |
| 2013/0050347 | A1 * | 2/2013 | Rivas et al. | 347/56 |

FOREIGN PATENT DOCUMENTS

JP 2009-208383 A 9/2009

* cited by examiner

*Primary Examiner* — Shelby Fidler
(74) *Attorney, Agent, or Firm* — Fitzpatrick, Cella, Harper & Scinto

(57) ABSTRACT

A liquid recording head includes a protective layer having resistance to liquid and an adhesiveness improving film disposed on a second surface of a silicon substrate, opposite to a first surface. The first surface and the second surface have a plane direction (100). The protective layer is disposed in a peripheral region of an opening of a liquid supply port. A liquid ejection chip is bonded to a head substrate with an adhesive so that the liquid supply port communicates with a liquid introduction port on a side of the second surface of the silicon substrate.

12 Claims, 5 Drawing Sheets

LIQUID RECORDING HEAD AND METHOD OF MANUFACTURING THE SAME

BACKGROUND OF THE INVENTION

1. Field of the Invention

The present invention relates to a liquid recording head which ejects liquid, and a method of manufacturing the liquid recording head. In addition, the present invention preferably relates to an ink jet head which ejects ink, and a method of manufacturing the ink jet head.

2. Description of the Related Art

Conventionally, there has been known a side shooter type ink jet head which ejects ink toward an upper region of an ejection energy generating element. This type of ink jet head is usually manufactured by bonding an ink jet chip constituted of a substrate to a head substrate having an ink introduction port.

When an ink jet chip is manufactured, a silicon substrate is usually used. There is one in which an ejection energy generating element, an ink flow path, and a nozzle for ejecting ink are formed on a surface of a silicon substrate, and an ink supply port is formed to penetrate from a back surface to a front surface of the substrate. The ink is supplied from the back surface of the substrate to the nozzle on the front surface of the substrate via the ink supply port penetrating the substrate from the back surface.

As a method of forming the ink supply port penetrating the silicon substrate from the back surface to the front surface, for example, there is a method of using anisotropic etching of silicon. This etching method utilizes a difference of etching rate with respect to a crystal orientation of silicon so that a desired shape is obtained.

It is known that, when this anisotropic etching is performed, a thermal oxide film is formed on the back surface of the silicon substrate as an etching mask. The thermal oxide film has high resistance to a strong alkaline solution, which is an etchant, and is therefore suitable for a mask material for the anisotropic etching. Further, the thermal oxide film is also superior in resistance to ink, and hence the thermal oxide film also functions as an ink protective layer of a silicon substrate to be exposed to the ink.

An ink jet chip in which an ink supply port is formed by anisotropic etching is bonded to a head substrate having an ink introduction port by using an adhesive or the like.

However, when this bonding with an adhesive is performed in a state in which the thermal oxide film as the ink protective layer is left on the back surface of the ink jet chip, high adhesive strength cannot be obtained in some cases. It is because the surface of the thermal oxide film has a small number of functional groups for a chemical bonding with the adhesive.

As a method of avoiding this, Japanese Patent Application Laid-Open No. 2009-208383 describes a method in which members are bonded with an adhesive after the ink protective layer having low adhesive strength is removed only from the adhesion site. The silicon substrate of the site from which the ink protective layer is removed becomes a silicon natural oxide film having a plenty of functional groups. Therefore, high adhesive strength can be obtained between the back surface of the silicon substrate and the head substrate when the bonding with an adhesive is performed.

In this way, with the silicon natural oxide film as the adhesive surface, high adhesive strength can be obtained. However, the silicon natural oxide film which is an adhesiveness improving film has low resistance to ink although it provides high adhesive strength for an adhesive. Recent inks frequently contain an alkali component, and so the silicon natural oxide film may be dissolved in the alkali component to some extent. When the ink in which silicon is dissolved is supplied to the nozzle for ejecting ink, and when the ejection energy generating element for generating heat is used, silicon may be deposited on the ejection energy generating element so that a desired ejection pressure cannot be obtained, or the deposited silicon may block the nozzle.

As a method of avoiding such a problem, for example, there is a method in which the silicon natural oxide film is completely covered with an adhesive for bonding the ink jet chip to the head substrate so that the silicon natural oxide film is not exposed to the ink. However, depending on assembly accuracy when the ink jet chip is bonded to the head substrate or dimension accuracy of each component, it may be difficult to completely cover the natural oxide film. In addition, there is a method of preparing an ink not to contain an alkali component, but possible ink formulations may be narrowed.

SUMMARY OF THE INVENTION

Therefore, it is an object of the present invention to provide a liquid recording head which is superior both in resistance to liquid such as ink and in adhesiveness.

According to an exemplary embodiment of the present invention, there is provided a liquid recording head, including: a liquid ejection chip including: a flow path forming layer for forming a liquid ejection orifice for ejecting liquid and a liquid flow path communicating to the liquid ejection orifice; and a silicon substrate that forms a liquid supply port for supplying the liquid to the liquid flow path and includes an ejection energy generating element for ejecting the liquid on a side of a first surface thereof, the flow path forming layer being disposed on the first surface side of the silicon substrate; and a head substrate that forms a liquid introduction port for supplying the liquid to the liquid supply port, in which: the first surface and a second surface opposite to the first surface of the silicon substrate have a plane direction (100); a protective layer having resistance to the liquid and an adhesiveness improving film are disposed on the second surface; the protective layer is disposed in a peripheral region of an opening of the liquid supply port; and the liquid ejection chip and the head substrate are bonded to each other with an adhesive on a side of the second surface side of the silicon substrate so that the liquid supply port communicates to the liquid introduction port.

Further, according to an exemplary embodiment of the present invention, there is provided a method of manufacturing a liquid ejection chip having at least a liquid supply port, the method including:

(1) preparing a silicon substrate having an ejection energy generating element for ejecting liquid on a side of a first surface thereof and having a thermal oxide film formed on a second surface opposite to the first surface, the first surface and the second surface having a plane direction (100);

(2) forming a resin layer on the thermal oxide film of the silicon substrate;

(3) removing a part of the resin layer corresponding to a region for forming the liquid supply port to form a first pattern in the resin layer;

(4) removing the thermal oxide film exposed at a bottom of the first pattern by using the resin layer as a mask;

(5) removing the resin layer while leaving the resin layer in at least a peripheral region of the first pattern to form a second pattern;

(6) subjecting the silicon substrate to anisotropic etching by using the thermal oxide film and the resin layer as masks to form the liquid supply port communicating from the second surface to the first surface in the silicon substrate;

(7) removing the thermal oxide film exposed at a bottom of the second pattern by using the resin layer as a mask; and (8) removing the resin layer.

Further, according to an exemplary embodiment of the present invention, there is provided a method of manufacturing a liquid recording head, including bonding, with an adhesive, the liquid ejection chip obtained by the above-described manufacturing method to a head substrate forming a liquid introduction port for supplying liquid to the liquid supply port.

Further features of the present invention will become apparent from the following description of exemplary embodiments with reference to the attached drawings.

DESCRIPTION OF THE EMBODIMENTS

Hereinafter, an embodiment of the present invention is described with reference to the attached drawings. Note that, an ink jet head is exemplified as an application of the present invention in this specification, but applications of the present invention are not limited to this. The present invention can also be applied to liquid recording heads for manufacturing biochips or printing electronic circuits. As the liquid recording head other than the ink jet head, there is a head for manufacturing a color filter, for example.

Figure 2:
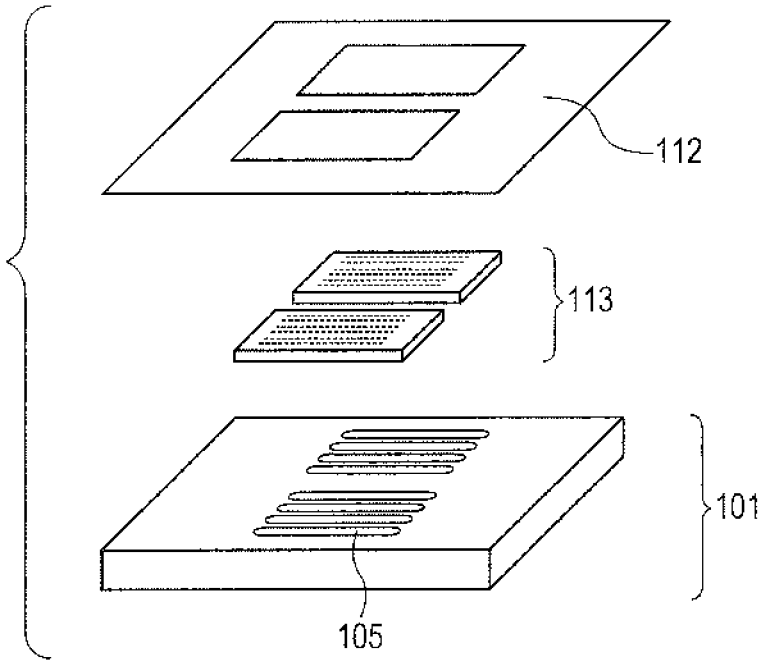
FIG. 2 is a schematic perspective exploded view for illustrating a structure of the liquid recording head according to the embodiment of the present invention.

First, FIG. 2 is a schematic exploded view of an ink jet head according to an embodiment of the present invention. An ink jet chip 113 as a liquid ejection chip including an ink supply port (liquid supply port), a nozzle, and an ejection energy generating element is bonded onto a head substrate 101 including an ink introduction port (liquid introduction port) 105 with an adhesive. Further, a wiring substrate 112 for electrically connecting the ink jet printer body to the ink jet chip 113 is bonded to the head substrate 101. The wiring substrate 112 and the ink jet chip 113 are electrically connected to each other (not shown).

Figure 1:
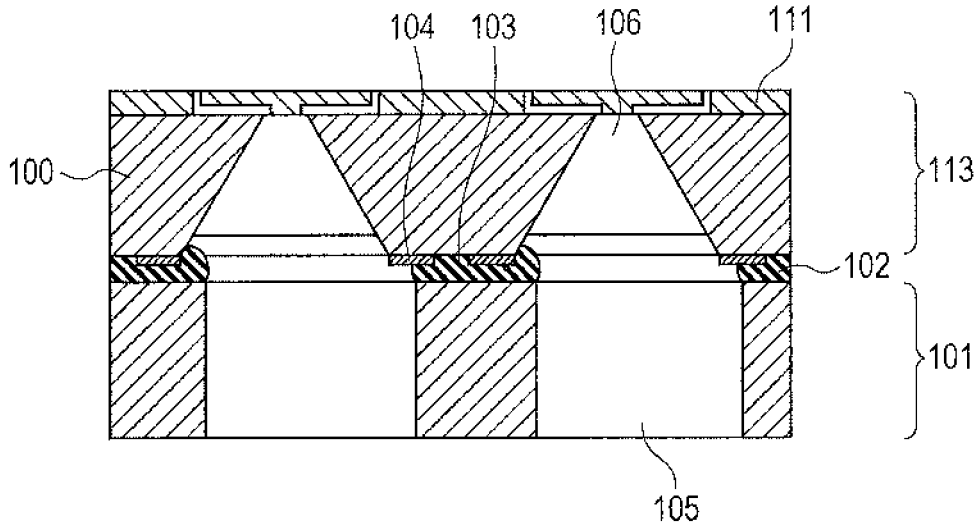
FIG. 1 is a schematic cross-sectional view for illustrating a structural example of a liquid recording head according to an embodiment of the present invention.

FIG. 1 is a schematic cross-sectional view of an ink jet head according to an embodiment of the present invention. In FIG. 1, the ink jet chip 113 includes a silicon substrate 100 having an ink supply port 106, and a flow path forming layer 111. On a front surface side of the silicon substrate 100 (the side on which the flow path forming layer 111 is disposed; hereinafter, referred to also as a side of a first surface), there is disposed an ejection energy generating element (not shown). The ink is ejected from an ink ejection orifice (liquid ejection orifice) by ejection energy generated by the ejection energy generating element. The ink is supplied from the ink supply port 106 to an ink flow path (liquid flow path). The nozzle is such a concept as to include an ink ejection orifice and an ink flow path. The flow path forming layer forms the ink ejection orifice for ejecting the ink and the ink flow path communicating to the ink ejection orifice.

The ink jet chip 113 is bonded to the head substrate 101 with an adhesive 102 so that the ink supply port 106 communicates to the ink introduction port 105. The ink is supplied from the ink introduction port 105 of the head substrate 101 to the ink supply port 106 of the ink jet chip. Then, the ink is supplied from the ink supply port 106 of the ink jet chip to the ink flow path. Below the ink ejection orifice of the ink jet chip, the ejection energy generating element (not shown) is disposed.

On a back surface (opposite to the first surface; hereinafter, referred to also as a second surface) of the silicon substrate 100 of the ink jet chip, there are disposed an ink protective layer 104 such as a thermal oxide film and an adhesiveness improving film 103 such as a natural oxide film. In other words, the ink protective layer 104 and the adhesiveness improving film 103 are disposed on the adhesion surface of the silicon substrate 100 for the head substrate 101. In the present invention, the first surface and the second surface of the silicon substrate 100 have a plane direction (100).

Here, the protective layer having resistance to liquid such as ink is disposed in the peripheral region of an opening of the liquid supply port, and hence elution of silicon can be inhibited.

The elution of silicon is apt to proceed from an edge of the opening of the liquid supply port, and hence it is preferred to dispose the protective layer along an opening edge of the liquid supply port.

As a material of the protective layer, for example, there are SiO, SiOC, SiON, Ta, Au, and the like. In addition, it is preferred that the SiO film be a thermal oxide film formed by thermal oxidation of a silicon substrate.

It is sufficient that the adhesiveness improving film is a film capable of improving adhesiveness for the adhesive. For instance, a natural oxide film of the silicon substrate, an Ni film, an Al film, a Cu film, and the like are mentioned. Among them, the natural oxide film of the silicon substrate is preferred as the adhesiveness improving film.

It is preferred that the adhesiveness improving film be disposed on the back surface of the silicon substrate in a region other than the region in which the protective layer is disposed. Thus, it is possible to improve adhesive strength between the silicon substrate and the head substrate by the adhesiveness improving film while protecting the periphery of the opening of the liquid supply port of the silicon substrate by the protective layer. In addition, the adhesiveness improving film can be formed easily because it is formed on the second surface having the plane direction (100). Further, by forming the adhesiveness improving film on the second surface having the plane direction (100), the opposed surfaces of the adhesiveness improving film and the head substrate can be substantially parallel. Therefore, the adhesive strength between the silicon substrate and the head substrate is more improved.

As illustrated in FIG. 1, when the ink jet chip 113 is bonded to the head substrate 101, depending on tolerances and assembly accuracy of the components, an edge of the ink supply port 106 of the ink jet chip may protrude over the ink introduction port 105 of the head substrate 101.

In addition, when the ink jet chip is bonded after the adhesive 102 is applied to the head substrate 101, depending on a variance due to the dimension tolerances thereof and the assembly tolerance thereof, an edge of the ink supply port 106 is not sometimes covered with the adhesive 102 so as to be exposed to the ink as illustrated in FIG. 1. However, in this embodiment, as illustrated in FIG. 1, on this protruding edge, namely the periphery of the opening of the ink supply port, the ink protective layer 104 such as the thermal oxide film is disposed. Therefore, even when the ink is supplied to the ink supply port 106 and the ink introduction port 105, silicon is inhibited from being dissolved in the ink. Further, the natural oxide film 103 as the adhesiveness improving film is disposed in the middle of the bonding part to the head substrate 101, and hence good adhesiveness between the ink jet chip and the head substrate 101 can be obtained.

Note that, there is also a method in which the adhesive 102 is applied to the ink jet chip side to bond the ink jet chip to the head substrate 101. With this method, it is possible to cover the adhesive surface of the ink jet chip with the adhesive 102.

The liquid supply port can be formed by subjecting the silicon substrate to anisotropic etching from the back surface side (second surface side). It is preferred that this anisotropic etching be a crystal anisotropic etching. The second surface of the silicon substrate has the plane direction (100), and hence a side wall of the liquid supply port can be formed appropriately at an angle of 54.7 degrees from the second surface by using the crystal anisotropic etching. In addition, the side wall has the plane direction (111), and hence resistance to the liquid such as ink is improved.

Figure 7:
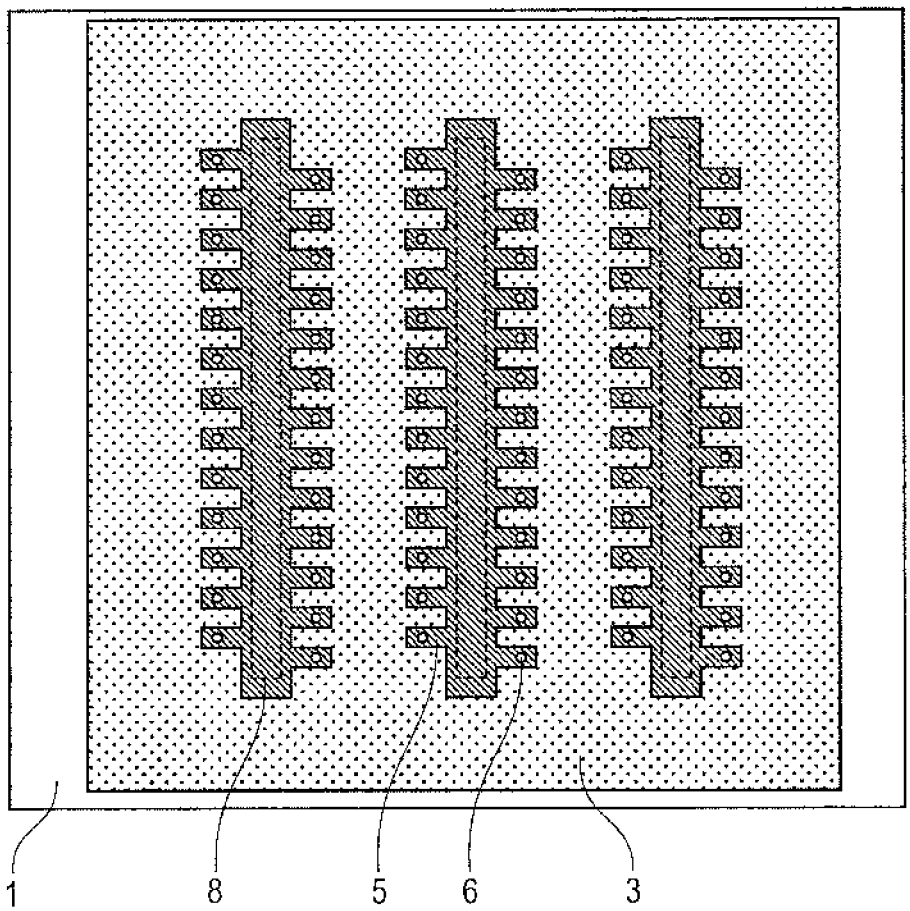
FIG. 7 is a schematic cross-sectional view for illustrating a structural example of the liquid recording head according to the embodiment of the present invention.
Figure 8:
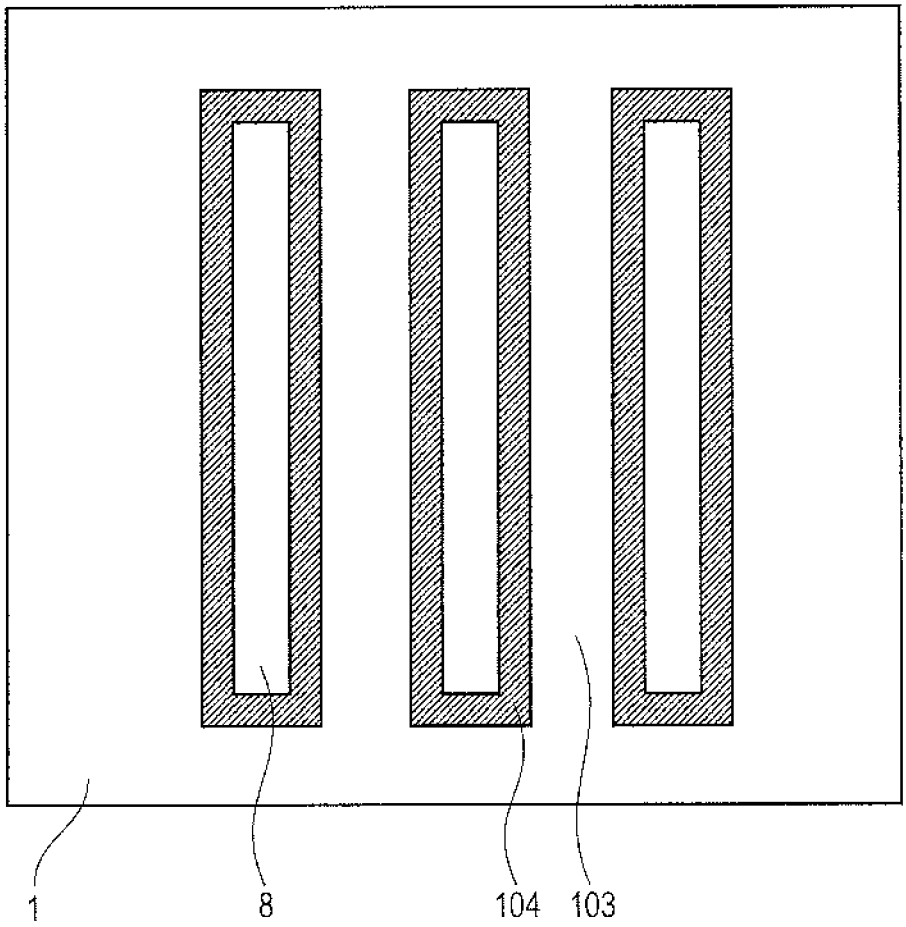
FIG. 8 is a schematic cross-sectional view for illustrating a structural example of the liquid recording head according to the embodiment of the present invention.

In FIG. 7, a flow path forming layer 3 includes multiple nozzle arrays each including ink ejection orifices, ink flow paths, and an ink supply port, which spatially communicate to one another. In other words, multiple ink flow paths 5 and ejection orifices 6 are disposed so as to form the multiple nozzle arrays. In addition, an ink supply port 8 penetrating a silicon substrate 1 is formed for each nozzle array. In addition, the nozzle arrays are disposed in rows. One nozzle array can keep and eject the same ink. FIG. 8 is a schematic plan view for illustrating the back surface side of the ink jet chip illustrated in FIG. 7. In FIG. 8, the ink jet chip includes the ink protective layer 104 and the adhesiveness improving film 103. As illustrated in FIG. 8, it is preferred that the ink protective layer 104 be disposed in a peripheral region of the ink supply port along the opening edge of the ink supply port. In addition, it is preferred that the adhesiveness improving film 103 be disposed at least between the nozzle arrays. In other words, it is preferred that the adhesiveness improving film be disposed on the back surface of the silicon substrate between ink supply ports (liquid supply ports) adjacent to each other, and between the protective layer disposed in the peripheral region of one ink supply port and the protective layer disposed in the peripheral region of another ink supply port. It is because adhesive strength can be improved also between nozzle arrays that are apt to cause a problem of adhesion by disposing the adhesiveness improving film 103 between the nozzle arrays.

First Embodiment and Example 1

Hereinafter, a manufacturing method according to the above-mentioned embodiment of the present invention is described. In addition, an example thereof is described.

Figure 3A:
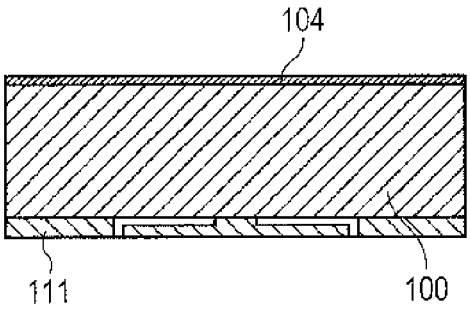
FIGS. 3A, 3B, 3C, 3D, 3E, 3F, 3G and 3H are schematic cross-sectional process views for illustrating an example of a method of manufacturing a liquid ejection chip according to an embodiment of the present invention.

First, as illustrated in FIG. 3A, the silicon substrate 100 having the flow path forming layer 111 on the first surface side (front surface side) is prepared. In FIG. 3A, on the first surface side of the silicon substrate 100 (front surface side; the lower side of the substrate in FIG. 3A), there is disposed the flow path forming layer 111 having the nozzle. The first surface and the second surface of the silicon substrate 100 have the plane direction (100). The thermal oxide film 104 is formed on the second surface of the silicon substrate 100.

In this example, the thermal oxide film 104 is formed by thermal treatment of the silicon substrate 100 at a temperature of 700° C.

A method of forming the flow path forming layer 111 is not limited to a particular method, but there is a method of forming the flow path forming layer 111 by using an inorganic film or an organic film, for example.

An example of the method of forming the flow path forming layer 111 by using an organic film is described below specifically. First, a positive photosensitive resin is laminated on the first surface of the silicon substrate 100 in adjustment with the ejection energy generating element. As the positive photosensitive resin, for example, a diazo naphthoquinone resin or an isopropenyl ketone resin can be used. After laminating the positive photosensitive resin, this resin is patterned so as to form the ink flow path by a photo-lithography method, and hence the ink flow path pattern is formed. Next, a negative photosensitive resin is laminated on the ink flow path pattern. As the negative photosensitive resin, an epoxy resin is suitable from a viewpoint of resistance to ink. After the negative photosensitive resin is laminated, the ink ejection orifice is formed in the negative photosensitive resin by the photo-lithography method. Next, the ink flow path pattern is dissolved and removed by using a solvent.

In this example, the flow path forming layer was formed by the forming method using the organic film. In this example, the isopropenyl ketone resin was used as the positive photosensitive resin serving as the ink flow path pattern, and a photo-cationic polymerization type alicyclic epoxy resin was used as the negative photosensitive resin to form the flow path forming layer.

Next, a step of forming the ink supply port 106 in the silicon substrate 100 is described.

First, the flow path forming layer 111 formed on the first surface side of the silicon substrate 100 is protected by a resin that can be easily removed by a solvent (not shown).

Figure 3B:
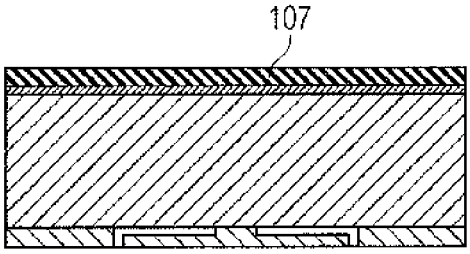

As illustrated in FIG. 3B, a mask material 107 constituted of a resin layer is disposed on the second surface of the silicon substrate 100, namely on the thermal oxide film 104.

The resin used as the mask material 107 may be a resin having resistance to the solution (for example, hydrofluoric acid) used for dissolving and removing the thermal oxide film 104, and it is preferred to use a thermoplastic resin. As the thermoplastic resin, it is preferred to use a polyamide resin from a viewpoint of its high resistance to chemicals. In addition, as the mask material 107, it is possible to use a photosensitive resin that can be patterned by the photo-lithography method.

In this example, the polyamide resin was used as the mask material 107.

Figure 3C:
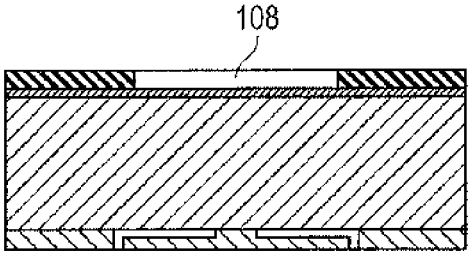

Next, as illustrated in FIG. 3C, the mask material 107 is patterned by a photo-lithography technique so as to remove a part of the mask material corresponding to a liquid supply port forming region, and hence a first pattern 108 is formed in the mask material.

When the thermoplastic resin is used as the mask material 107, another photosensitive resin is used for patterning by the photo-lithography technique. In this case, another photosensitive resin is disposed on the mask material 107, the photosensitive resin is patterned by the photo-lithography technique, and the mask material 107 is etched by using the patterned photosensitive resin so that the first pattern 108 is formed. The photosensitive resin can be removed by the solvent.

As illustrated in FIG. 3C, this first pattern 108 is an ink supply port forming pattern for forming the ink supply port 106 that is formed later.

Figure 3D:
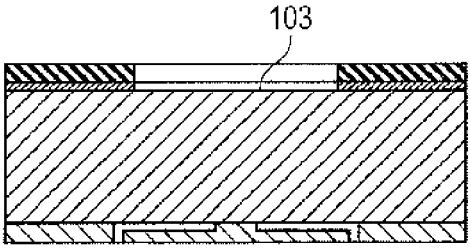

Next, as illustrated in FIG. 3D, the silicon substrate 100 is dipped in hydrofluoric acid, and the thermal oxide film 104 exposed at the bottom of the first pattern is removed by using the mask material 107 having the first pattern 108. The region from which the thermal oxide film 104 is removed becomes a silicon surface, and silicon of the silicon surface is oxidized by the oxygen in the air so that the natural oxide film 103 is formed.

Figure 3E:
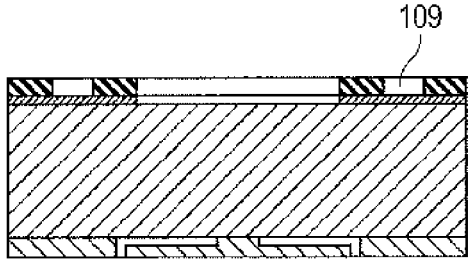

Next, as illustrated in FIG. 3E, a second pattern 109 is formed in the mask material 107. The second pattern is formed by removing the mask material except for at least the peripheral region of the first pattern to be left. In other words, the second pattern is formed by removing at least a part of the region of the first pattern except for the peripheral region thereof. In addition, the second pattern 109 can be formed by the same procedure as that for forming the first pattern 108. As illustrated in FIG. 3E, the second pattern 109 is formed in a region separated from the ink supply port forming pattern via the mask material 107. In this case, the thermal oxide film in the region of the second pattern 109 is not dissolved or removed.

Figure 3F:
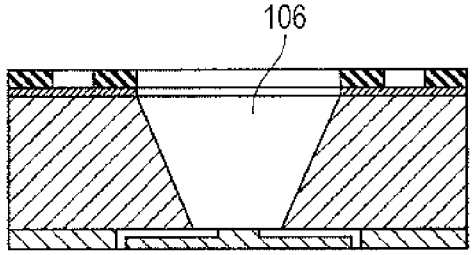

Next, the silicon substrate 100 is dipped in an alkaline solution. In the first pattern region in which the thermal oxide film 104 is removed, etching of the silicon substrate 100 by the alkaline solution proceeds, and the ink supply port 106 is formed toward the first surface of the silicon substrate 100 as illustrated in FIG. 3F. The etching is performed until reaching the first surface. By this crystal anisotropic etching of silicon, the side wall of the ink supply port 106 is formed along the crystal orientation (111). The angle of the side wall is 54.7 degrees with respect to the substrate surface.

Note that, the thermal oxide film is disposed in the region of the second pattern 109, and hence etching of the silicon substrate 100 by alkali does not occur.

In addition, when the ink supply port 106 is formed, an etching stop layer may be disposed on the first surface of the silicon substrate 100. In this example, a thermal oxide film as the etching stop layer is disposed on the first surface of the silicon substrate 100 (not shown). As the etching stop layer, for example, a silicon oxide film can be used.

Figure 3G:
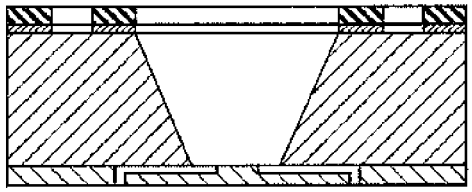

Next, the silicon substrate 100 in which the ink supply port 106 is formed is dipped in the hydrofluoric acid. The thermal oxide film 104 exposed at the bottom of the second pattern 109 of the mask material 107 is removed by this hydrofluoric acid, and hence silicon is exposed as illustrated in FIG. 3G.

Note that, in the example, when the thermal oxide film was removed by this hydrofluoric acid, the thermal oxide film as the above-mentioned etching stop layer was also removed simultaneously.

Silicon exposed at the bottom of the second pattern 109 is oxidized by the oxygen in the air into the natural oxide film 103. In other words, the natural oxide film 103 is formed on the second surface having the plane direction (100).

Figure 3H:
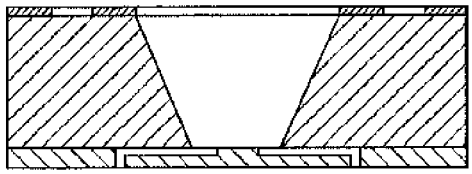

Next, as illustrated in FIG. 3H, the mask material 107 is removed by dry etching so that an ink jet chip is obtained.

In this ink jet chip, the thermal oxide film 104 remains around the opening of the ink supply port 106 on the second surface of the silicon substrate. This thermal oxide film 104 functions as the ink protective layer, and hence even when the ink flows in the ink supply port 106, dissolution of the silicon substrate 100 by the ink is inhibited. In addition, the natural oxide film 103 is present on the flat surface portion of the second surface of the silicon substrate around the ink supply port 106 via the thermal oxide film 104, and hence high adhesive strength can be obtained when the ink jet chip is bonded to the head substrate 101 with the adhesive 102. In addition, the ink jet chip manufactured in this example can provide both high adhesive strength and high resistance to ink even when the ink jet chip is bonded to the head substrate 101 with a variance due to the process accuracy or the component accuracy.

Next, the obtained ink jet chip is bonded to the head substrate 101 with the adhesive 102. As the adhesive 102 for bonding to the head substrate 101, for example, an epoxy or acrylic adhesive 102 can be used. From viewpoints of high resistance to ink and adhesiveness, an epoxy adhesive 102 is used suitably.

In this example, a thermosetting epoxy adhesive was used for bonding the ink jet chip to the head substrate so that the ink jet head was obtained. In addition, in this example, the adhesive 102 was applied to the head substrate 101 so as to bond the ink jet chip.

The ink jet head obtained in this example did not cause dissolution of the silicon substrate and was superior in adhesiveness between the ink jet chip and the head substrate 101 to have high reliability.

Second Embodiment

Figure 4:
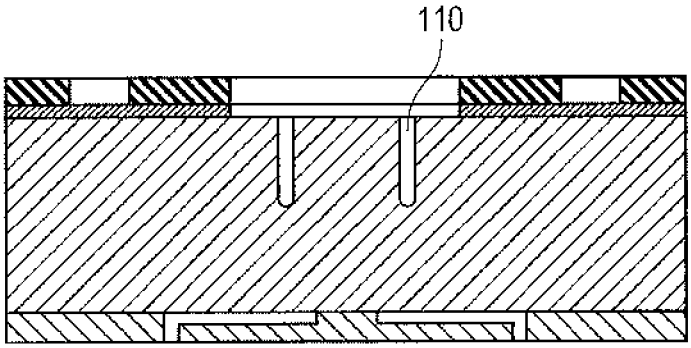
FIG. 4 is a schematic cross-sectional process view for illustrating an example of the method of manufacturing a liquid ejection chip according to the embodiment of the present invention.

When the ink supply port is formed, it is possible to form holes by a laser in the part in which the thermal oxide film 104 is removed, and then to perform the crystal anisotropic etching of silicon as illustrated in FIG. 4. Thus, as illustrated in FIG. 5, an ink supply port having a rhombus-like cross-sectional shape ('< >' shape) can be formed.

Through the formation of guiding holes by the laser, the etching time for performing the anisotropic etching of silicon can be significantly reduced. This is because, when the silicon substrate 100 is dipped in the alkali liquid in the state in which laser holes 110 are formed in the silicon substrate 100 as illustrated in FIG. 4, the alkali liquid enters the laser holes 110 so that the etching is performed also from the inside of the silicon substrate, with the result that significant reduction of the tact can be achieved.

Figure 5:
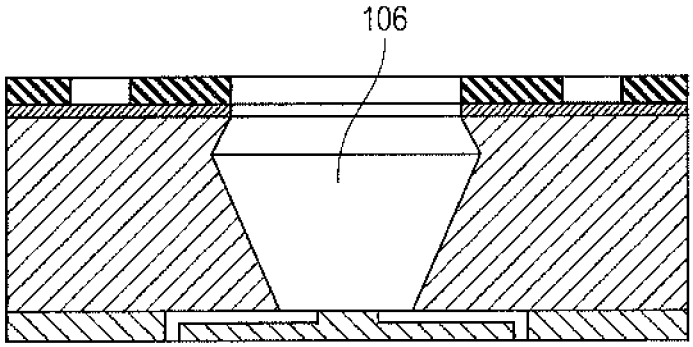
FIG. 5 is a schematic cross-sectional process view following FIG. 4, for illustrating an example of the method of manufacturing a liquid ejection chip according to the embodiment of the present invention.
Figure 6:
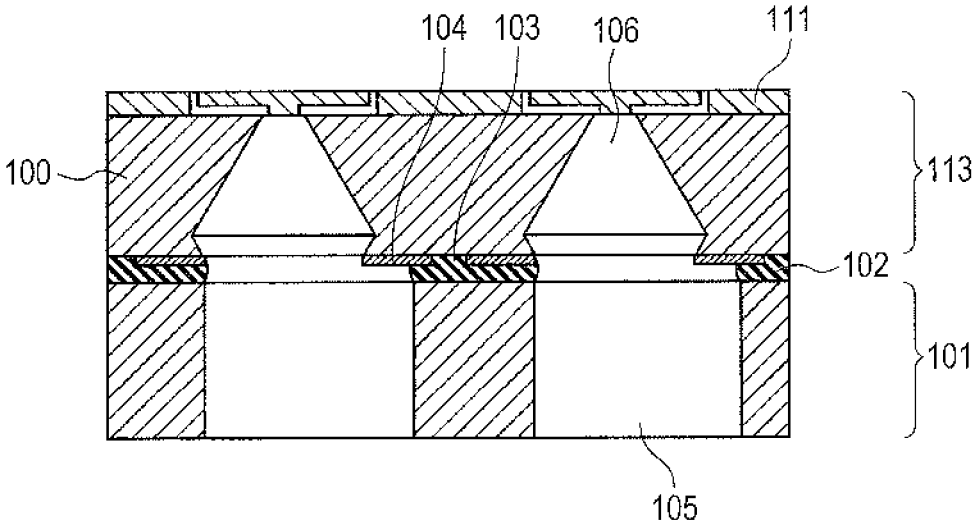
FIG. 6 is a schematic cross-sectional view for illustrating a structural example of the liquid recording head according to the embodiment of the present invention.

Note that, the ink jet chip manufactured by the same method as in the example described above except for the above-mentioned method had the ink supply port 106 formed in a rhombus-like cross-sectional shape as illustrated FIG. 5. The ink jet chip after the laser holes are formed as illustrated in FIG. 5 has the bonding surface to the head substrate 101, which has high resistance to ink in the part exposed to the ink because the thermal oxide film 104 is disposed around the ink supply port 106 similarly to the example described above. Further, the flat surface portion via the thermal oxide film 104 is the silicon natural oxide film 103, and hence high adhesive strength to the head substrate 101 can be obtained. Thus, in this example too, it was possible to obtain the ink jet head including the ink jet chip having high adhesiveness and high resistance to ink as illustrated in FIG. 6.

Comparative Example

Hereinafter, a comparative example is described. In the comparative example, the process until FIG. 3E was performed similarly to Example 1.

Next, the thermal oxide film in the region of the second pattern 109 was etched by using a reactive ion etching (RIE) apparatus so that the silicon substrate 100 was exposed.

Next, as illustrated in FIG. 3F, the ink supply port 106 was formed. In this case, the silicon substrate 100 was exposed in the region of the second pattern 109, and hence the etching proceeded from this region as well, and a recess constituted of surfaces of the crystal orientation (111) was formed. After the ink supply port and the recess were formed, the mask material 107 was removed by dry etching so that the ink jet chip was obtained. After that, the process was performed similarly to Example 1.

The ink jet head obtained in the comparative example was slightly inferior to that in Example 1 in terms of adhesiveness between the ink jet chip and the head substrate 101.

According to the present invention, it is possible to provide a liquid recording head which is superior both in resistance to liquid such as ink and in adhesiveness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-199499, filed Sep. 13, 2011, which is hereby incorporated by reference herein in its entirety.

What is claimed is:

1. A liquid recording head, comprising:

a liquid ejection chip comprising:

a flow path forming layer for forming a liquid ejection orifice for ejecting liquid and a liquid flow path communicating with the liquid ejection orifice; and a silicon substrate that forms a liquid supply port for supplying the liquid to the liquid flow path and comprises an ejection energy generating element for ejecting the liquid on a side of a first surface thereof, the flow path forming layer being disposed on the first surface side of the silicon substrate; and a head substrate that forms a liquid introduction port for supplying the liquid to the liquid supply port, wherein:

the first surface and a second surface opposite to the first surface of the silicon substrate have a plane direction (100), a protective layer having resistance to the liquid and an adhesiveness improving film are disposed on the second surface, the protective layer is disposed in a peripheral region of an opening of the liquid supply port, the protective layer being disposed closer to the liquid supply port than the adhesiveness improving film is to the liquid supply port, and the liquid ejection chip and the head substrate are bonded to each other with an adhesive on a side of the second surface of the silicon substrate so that the liquid supply port communicates with the liquid introduction port, the adhesive being in contact with the protective layer and the adhesiveness improving film.

2. A liquid recording head according to claim 1, wherein the protective layer is disposed along an opening edge of the liquid supply port.

3. A liquid recording head according to claim 1, wherein the adhesiveness improving film is disposed on the second surface of the silicon substrate in a region other than a region in which the protective layer is disposed.

4. A liquid recording head according to claim 1, wherein:

the flow path forming layer comprises multiple nozzle arrays, each including liquid ejection orifices and liquid flow paths that spatially communicate with each other, a liquid supply port is formed for each of the multiple nozzle arrays, and between the liquid supply ports adjacent to each other on the second surface, the adhesiveness improving film is disposed between the protective layer disposed in the peripheral region of one of the adjacent liquid supply ports and the protective layer disposed in the peripheral region of the other of the adjacent liquid supply ports.

5. A liquid recording head according to claim 1, wherein the protective layer comprises one of SiO, SiOC, SiON, and Ta.

6. A liquid recording head according to claim 1, wherein the adhesiveness improving film is one of a natural oxide film of the silicon substrate, an Ni film, an Al film, and a Cu film.

7. A liquid recording head according to claim 1, wherein the liquid recording head is an ink jet head for ejecting ink as the liquid.

8. A liquid recording head according to claim 1, wherein the protective layer comprises Au.

9. A liquid recording head according to claim 1, wherein the protective layer is exposed to the liquid supply port.

10. A liquid recording head according to claim 1, wherein the adhesiveness improving film is not exposed to the liquid supply port.

11. A liquid recording head according to claim 1, wherein the protective layer is in contact with the liquid.

12. A liquid recording head according to claim 1, wherein the adhesiveness improving film is not in contact with the liquid.

* * * * *